United States Patent [19]

Yamane et al.

[11] Patent Number: 4,938,730

[45] Date of Patent: Jul. 3, 1990

[54] TOY HOUSE WITH MAGNETICALLY ACTUATED LIGHT

[75] Inventors: Yuji Yamane; Hideya Nishikawa; Tetsuya Joja, all of Tokyo, Japan

[73] Assignee: Tomy Kogyo Co., Inc., Katsushika, Japan

[21] Appl. No.: 204,505

[22] Filed: Jun. 9, 1988

[30] Foreign Application Priority Data

Oct. 28, 1987 [JP] Japan ..... 62-164856[U]

[51] Int. Cl.[5] ..... A63H 33/26

[52] U.S. Cl. ..... 446/130; 446/129; 446/477; 446/485

[58] Field of Search ..... 446/129, 130, 131, 132, 446/133, 134, 135, 136, 137, 139, 477, 485

[56] References Cited

U.S. PATENT DOCUMENTS

| | | | |
|---|---|---|---|
| 2,544,034 | 3/1951 | Levering | 446/477 |
| 2,749,663 | 6/1956 | Lemelson | 446/130 |
| 3,223,412 | 12/1965 | Freeman et al. | 446/129 X |
| 3,232,004 | 2/1966 | Felsher | 446/130 |
| 3,266,187 | 8/1966 | Felsher | 446/130 |
| 4,233,778 | 11/1980 | Lemelson | 446/132 X |

· FOREIGN PATENT DOCUMENTS

| | | | |
|---|---|---|---|
| 1160438 | 7/1958 | France | 446/477 |
| 1564120 | 4/1980 | United Kingdom | 446/130 |

*Primary Examiner*—Robert A. Hafer
*Assistant Examiner*—Sam Rimell
*Attorney, Agent, or Firm*—Staas & Halsey

[57] ABSTRACT

A toy house has a lamp for illuminating an interior of the toy house and a switch which is magnetically actuated by placing a play piece having magnet disposed in its bottom surface area in proximity to an end of a lever which carries magnetically attractable material. When the end of the lever moves towards the play piece due to magnetic attraction, the opposite end of the lever causes two contacts to come into electrical contact with each other.

8 Claims, 1 Drawing Sheet

TOY HOUSE WITH MAGNETICALLY ACTUATED LIGHT

BACKGROUND OF THE INVENTION

1. Field of the Invention

The present invention relates generally to toy houses, and more particularly, to toy houses having lights switched on and off magnetically.

2. Description of the Related Art

Conventional lights for lighting a toy house use switches which are manually actuated by moving a knob between on and off positions. Typically, the knob moves linearly, and an appendage beneath the knob pushes one of two electrical contacts into contact with the other contact thereby completing an electrical circuit which powers the light.

Although the conventional knob-type electrical switch for lights used in toy houses is effective, manipulation of the knob by children playing with the toy house requires no imagination and presents an unsightly appearance. Moreover, with the conventional switch, dolls or play pieces associated with the toy house cannot participate in the switching on and off of the light.

SUMMARY OF THE INVENTION

An object of the invention is to provide an electrical switch for a toy house which requires no manual manipulation of a knob.

Another object of the invention is to provide an electrical switch for a toy house which is automatically actuated by moving play pieces such as dolls.

Another object of the invention is to provide a toy house which is easy to assemble and cost effective to produce.

Yet another object of the invention is to provide a toy house which allows greater imagination on the part of the children playing with the toy.

In a preferred embodiment of the invention, a house toy comprises an electrical circuit including a light and a battery power source, first and second electrical contacts coupled to the electrical circuit and being normally spaced apart to provide an open circuit, a house member having an interior which is illuminated by the light when the electrical circuit is closed, and magnetic actuator means for opening and closing the electrical circuit. The magnetic actuator means includes a pivoting lever which has magnetic material embedded in one end thereof. A play piece has a magnet embedded in a bottom thereof such that when the play piece is placed near the magnetic material, the lever moves by magnetic attraction. By mounting the lever on a fulcrum, the end of the lever opposite the magnetic material moves in an opposite direction and is positioned so as to bring two electrical contacts together as a result of the lever movement.

These and other features and advantages of the lighted house toy of the invention will become more apparent with reference to the following detailed description and drawings.

DETAILED DESCRIPTION OF THE PREFERRED EMBODIMENTS

Figure 1:
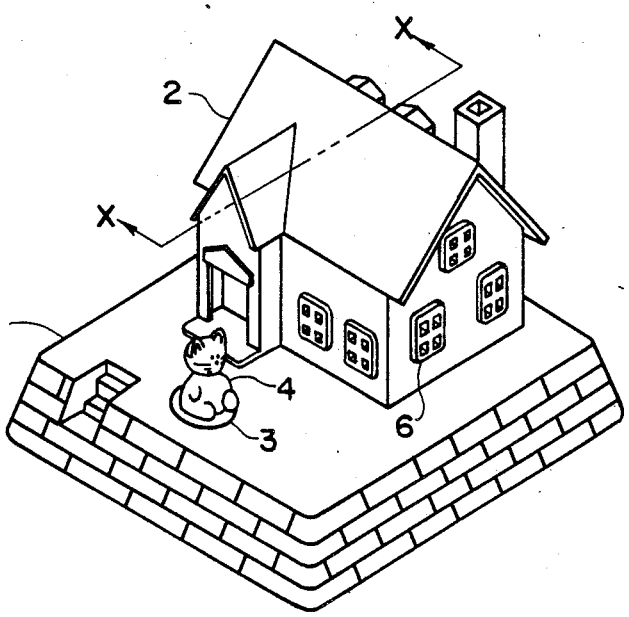
FIG. 1 is a perspective view of a preferred embodiment of the toy house of the present invention.
Figure 2:
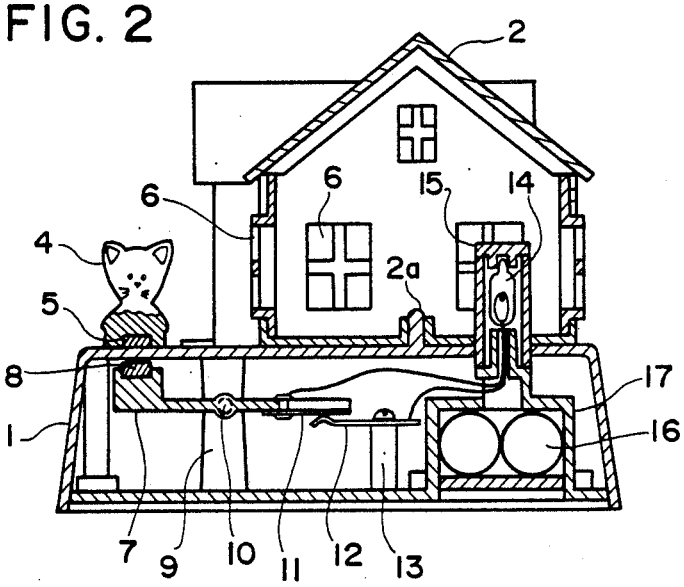
FIG. 2 is a cross-sectional view of the embodiment of FIG. 1, taken along line X—X.

Referring to FIGS. 1 and 2, a toy house has a base 1 having top, bottom, and side walls which define an interior chamber. A house 2 is disposed on the outer surface of the top wall and is held in place by fitting onto one or more pegs 2*a*, which extend upwardly from the upper surface of the top wall of the base 1.

The outer surface of the top wall of the base 1 has an area 3 which is marked for placement of a doll or play piece 4 which cooperates with means within the base 1 for actuating a switch. The play piece 4 has a permanent magnet 5 embedded in a bottom thereof. The permanent magnet 5 is substantially flush with the flat bottom of the play piece 4. As will be described in greater detail, when the play piece 4 is placed on the marked area 3, a switch is actuated to turn on the light within the house 2.

The house 2 includes a plurality of windows 6 which light up when a light 14 within the house 2 is powered.

Within the interior chamber of the base 1, a lever 7 is pivotally connected to a vertical support 9 by a pivot pin 10 formed at a medial portion of the lever 7. A distal end of the lever 7 is provided with a magnetic member 8 made of any suitable magnetically attractive material. Normally, the weight of the lever 7 and magnetic material 8 is such that the lever pivots to lower the metallic material 8 away from the top wall of the base 1. In this position, two electrical contacts 11 and 12 become spaced apart, thereby creating an open circuit which prevents the light 14 from being powered. The light 14 is electrically connected to the circuit which includes the two contacts 11 and 12. A cover 15 is preferably disposed over the light 14 and is snapped fitted to an upper portion of a battery receptacle 17 disposed within the base 1 for housing batteries 16. A boss 13 is provided adjacent the proximal end of the lever 7 so as to support contact 12. In the embodiment of FIG. 2, the other contact 11 is supported on the proximal end of the lever 7.

To turn on the light 14, a child playing with the toy house places the play piece 4 on the marked area 3 as shown in FIGS. 1 and 2. The magnet 5 disposed in the bottom of the play piece 4 attracts the magnetic material 8 provided in the distal end of the lever 7, thereby causing the lever 7 to rotate under the force of the magnetic attraction between the play piece 4 and the magnetic material 8. Rotation causes the two electrical contacts 11 and 12 to come into contact with each other, thereby closing the circuit which includes the light 14 and the battery 16. When the play piece 4 is removed from the base 1, the force of gravity causes the lever 7 to rotate as previously mentioned, thereby causing the contacts 11 and 12 to separate. A stopper (not shown) may be provided to limit the amount of movement of the lever 7 to that which is necessary to cause the contacts 11 and 12 to touch.

It is possible for the boss to support two electrical contacts which are normally spaced apart. The proximal end of the lever 7 would then push the two contacts into contact with each other when that end of the lever moves downwardly due to lever rotation. The proximal end of the lever may be provided with a downwardly extending boss which facilitates pushing the two contacts together. The two contacts are made of a thin metallic material which is naturally flexible under slight pressure exerted by the lever. After rotation of the lever, the spring force of the two contacts causes the two contacts to become spaced apart once again.

According to the embodiments described above, it is unnecessary to provide an operation knob for turning on and off the lamp. Instead, a child can use his or her imagination to place the play piece 4 on the mark area 3 and simulate the switching on and off of a light for a house.

The play piece 4 is preferably shaped in an animal shape, such as a cat. Other suitable shapes may be used.

Numerous modifications and adaptations of the lighted house toy of the present invention will be apparent to those skilled in the art and thus, it is intended by the following claims to cover all such modifications and adaptations which fall within the true spirit and scope of the invention.

What is claimed is:

1. A toy house comprising:

an electrical circuit including a light and a battery power source;

first and second electrical contacts coupled to the electrical circuit and being normally spaced apart to provide an open circuit;

a house member having windows and an interior, wherein the light is mounted in the house member which is illuminated by the light when the electrical circuit is closed;

magnetic actuator means for opening and closing the electrical circuit; and a base member having top, bottom, and side walls defining an interior chamber, the house member being supported on the top wall of the base member;

wherein the magnetic actuator means comprises a play piece having a magnet disposed therein, a lever pivotally supported inside the base member and having a distal end for carrying magnetic material and an opposite, proximal end for moving the first and second electrical contacts together, the magnetic material being attractable to the magnet in the play piece when the play piece is placed on the top wall to the base member, thereby causing the first and second electrical contacts to move into contact.

2. A house toy according to claim 1, wherein the house member includes a plurality of windows.

3. A house toy according to claim 1 wherein the first electrical contact is stationary and the second electrical contact is movable with the lever.

4. A toy house comprising:

a base member having top, bottom and side walls defining an interior chamber;

a house member detachably connected to the top wall of the base;

a light disposed at least partially inside the house member;

a battery power supply disposed within the base member for powering the light;

first and second electrical contacts electrically coupled to the light and being normally spaced apart to provide an open circuit which prevents the power source from powering the light; and magnetic actuator means disposed at least partially outside the base member for moving the first and second electrical contacts into contact with each other, thereby closing the circuit.

5. A toy house according to claim 4, wherein the magnetic actuator means comprises a pivotal lever having a distal end carrying magnetic material and a proximal end in proximity to the first and second electrical contacts and a medial portion pivotally supported within the base member, and a magnet movable to a marked area of the top wall of the base member in substantial vertical alignment with the magnetically attractable material to magnetically attract the magnetic material and cause the proximal end of the lever to move the first and second electrical contacts into electrical contact with each other.

6. A toy house according to claim 4 wherein the house member includes a plurality of windows.

7. A toy house according to claim 5, wherein the bottom wall of the base member is detachably connected to the top wall and includes a battery receptacle, a mount for mounting the lamp, and a vertical support for pivotally supporting the lever.

8. A toy house according to claim 6, wherein the light extends through the top wall of the base member and into the interior of the house member.

* * * * *